United States Patent [19]

Okamoto et al.

[11] 4,050,609

[45] Sept. 27, 1977

[54] HEAT INSULATING DEVICE FOR LOW TEMPERATURE LIQUIFIED GAS STORAGE TANKS

[75] Inventors: Tomiyasu Okamoto; Tsunanori Nishimoto; Kaoru Sawada; Koji Hayakawa; Tomomichi Kurihara, all of Osaka, Japan

[73] Assignee: Hitachi Shipbuilding & Engineering Co., Osaka, Japan

[21] Appl. No.: 722,718

[22] Filed: Sept. 13, 1976

[51] Int. Cl.[2] ..... B65D 87/24; B63B 25/16

[52] U.S. Cl. ..... 220/9 LG; 114/74 A; 220/15

[58] Field of Search ..... 220/9 A, 9 F, 9 LG, 220/10, 15; 114/74 A; 62/45, 50, 54; 137/583, 587; 52/573

[56] References Cited

U.S. PATENT DOCUMENTS

| | | | |
|---|---|---|---|
| 3,079,026 | 2/1963 | Dosker | 220/9 LG |
| 3,112,043 | 11/1963 | Tucker | 220/15 X |
| 3,142,159 | 7/1964 | Berland | 62/54 X |
| 3,411,656 | 11/1968 | Jackson | 220/9 LG X |
| 3,670,917 | 6/1972 | Nishimaki et al. | 220/9 F X |
| 3,769,118 | 10/1973 | Tariel et al. | 220/9 LG X |
| 3,773,604 | 11/1973 | Desai et al. | 220/9 LG |
| 3,780,900 | 12/1973 | Yamamoto | 220/9 LG |
| 3,921,438 | 11/1975 | Katsuta | 220/9 LG X |
| 3,948,198 | 4/1976 | Yamamoto et al. | 220/9 LG X |
| 3,975,879 | 8/1976 | Birch et al. | 220/9 LG X |

FOREIGN PATENT DOCUMENTS

| | | | |
|---|---|---|---|
| 860,815 | 2/1961 | United Kingdom | 220/9 LG |
| 1,112,082 | 5/1968 | United Kingdom | 62/45 |
| 932,581 | 7/1963 | United Kingdom | 220/9 LG |

*Primary Examiner*—Stephen Marcus
*Attorney, Agent, or Firm*—Joseph W. Farley

[57] ABSTRACT

An insulating construction for a low temperature liquified gas storage tank consists of a plurality of heat insulating blocks or plates of rigid foam, each covered with a gas-tight sheet bonded thereto and each bolted at its approximate center to the outer wall of the tank. The joints between adjacent plates are filled with a heat insulating material and a gas-tight cover is applied to the exposed portions of this filler material and to the exposed ends of the bolts. Preferably, the inner surfaces of the plates are separated from the outer wall of the tank by spacers, providing a space which is filled with a soft foam resin and which forms a passage for conducting any leakage gas from the tank to a pipe located in a plate below the bottom of the tank and discharging such gas to the outside of the insulating construction.

9 Claims, 9 Drawing Figures

HEAT INSULATING DEVICE FOR LOW TEMPERATURE LIQUIFIED GAS STORAGE TANKS

The present invention relates to a heat insulating device for low temperature liquified gas storage tanks, and more particularly it relates to a heat insulating device for spherical tanks.

A spherical tank for storing low temperature liquidifed gas has a small outer wall area for its volume and hence it requires a small amount of material and is advantageous from the standpoint of strength. However, since its outer wall surface is a three-dimensional curved surface, the mounting of a heat insulating device on the outer wall surface of such spherical tank presents a number of problems which must be solved, including equalizing the thickness of heat insulating layers and securing and facilitating the attachment thereof; securing heat insulation at junctions between heat insulating blocks; and prevention of sea water or liquified gas from pentrating the heat insulating material even is the ship's hull or the tank is broken.

The main object of the present invention is to provide a heat insulating device which can be simply and securely applied to an outer tank wall surface of such curved surface construction. The heat insulating device of the invention is characterized in that it comprises heat insulating unit block plates of rigid foam synthetic resin performed into a square or trapezoidal shape and having a predetermined thickness, each of said block plates having a gas-tight sheet bonded thereto to cover the same and also having a substantially centrally disposed through-hole for receiving a stud bolt set in an outer tank wall, bolts of heat insulating material adapted to be inserted in said through-holes and threadedly engageable at their front ends with said stud bolts, a heat insulating filler filling the joints between said block plates, and gas-tight sheets for covering the exposed top portions of said heat insulating bolts and filler.

Accoding to this arrangement of the invention, the use of unit block plates of heat insulating material facilitates the transport thereof to a work site without the danger of damaging them, and since such unit block plates are each attached to an outer tank wall surface by being pressed thereagainst by using a single heat insulating bolt, the attachment of heat insulating members can be very easy performed and even in the case of an outer tank surface of curved surface construction it is possible to attach the heat insulating members along such surface. Further, since heat insulating bolts are used and the joints between block plates is filled with a heat insulating filler, there is no danger of decreasing the heat insulating effect. According to a preferred embodiment, plywood sheet and a gas-tight sheet are bonded to the front surface of each block plate to cover the same while a plywood sheet is also bonded to the back surface and the exposed top portions of heat insulating bolts and filler are covered with second gas-tight sheets, so that the heat insulating effect is maintained even if the ship's hull is broken or the low temperature liquified gas leaks, without the danger of sea water or leakage gas penetrating or passing therethrough.

According to a desirable embodiment of the invention, a plurality of point spacers are interposed between the back surfaces of said block plates and the outer tank surface to define a space therebetween. According to a more desirable embodiment, such space is filled with a soft foam synthetic resin. With such arrangement, square or trapezoidal blocks of uniform thickness can be easily attached along a curved surface and overtightening of the block plates by the insulating bolts can be prevented. Further, such arrangement provides a flow pasage which, in case the tank should crack and leak, guides the leakage gas to a suitable reservoir. Further, if this space is filled with a soft foam resin, the heat insulating function can be improved while allowing the flow of leakage gas.

According to another embodiment of the invention, at or in the vicinity of the tank, there is provided a communication pipe allowing the space between said block plates and the outer tank wall surface to communicate with the outside of the heat insulating block plates. According to a more desirable embodiment, said communication pipe as well as said space is filled with a soft foam synthetic resin. With such arrangement, leakage gas flows down the flow passage defined by said space and collects in a space below the lower end of the tank, from which it can be discharged through the communication pipe to the outside of the heat insulating device. Further, if the communication pipe is filled with a soft foam synthetic resin, the leakage gas can be discharged by the difference in the pressures in the space and in the outside without spoiling the heat insulating effect and gas tightness.

Other numerous features and merits of the present invention will be readily understood from the following description of preferred embodiments of the invention.

Figure 2:
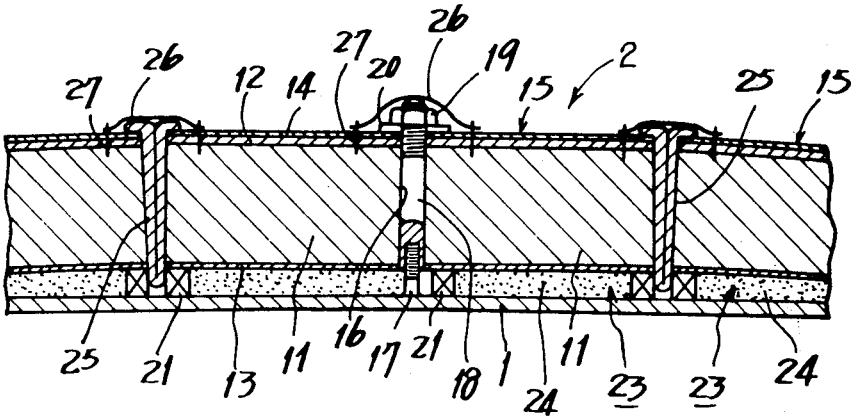
FIG. 2 is a sectional view of a heat insulating device.
Figure 2A:
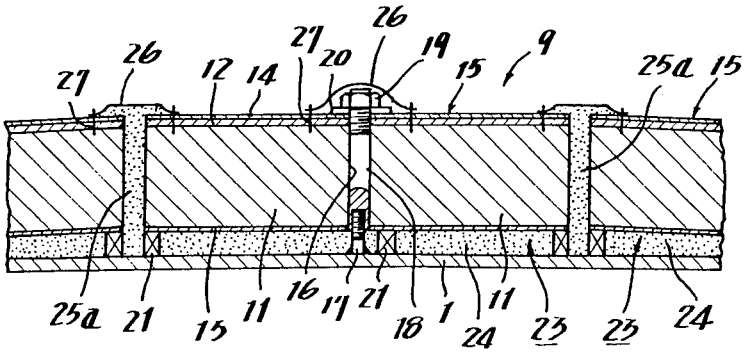
Figure 4:
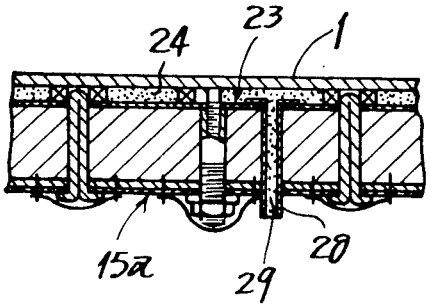
Figure 5:
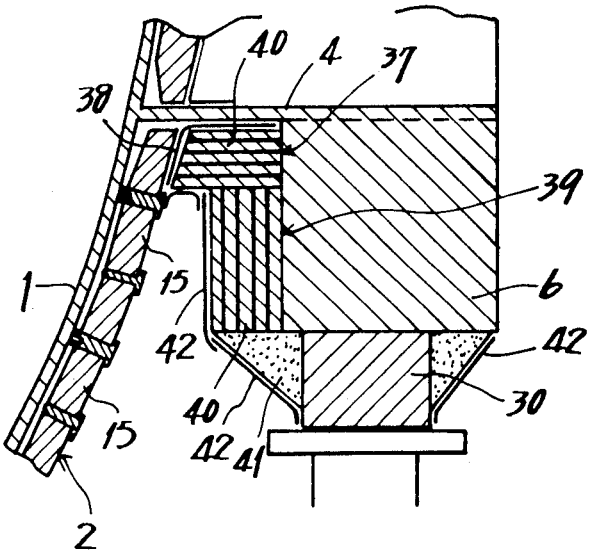
Figure 6:
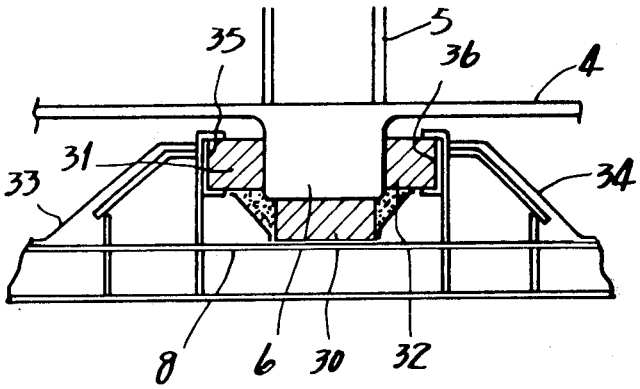

FIG. 2*a* is a sectional view similar to FIG. 2 showing an alternate form of joint construction;

FIG. 3*a*—3*d* are sectional views illustrating the steps of assembling the heat insulating device;

FIG. 4 is a sectional view illustrating the lower end portion of the tank with the heat insulating device;

FIG. 5 is a sectional view illustrating the heat insulating construction at the tank support portion; and FIG. 6 is a front view of the same.

Figure 1:
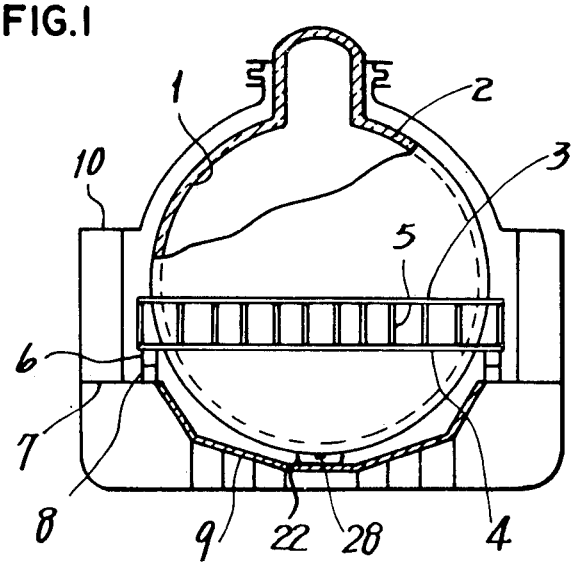
FIG. 1 is a partly broken-away cross-section of a low temperature liquified gas carrying vessel having a spherical tank.

In FIG. 1, the character 1 is an outer tank wall; 2, a heat insulating device attached to the surface of the outer tank wall 1; 3 and 4, upper and lower horizontal support rings horizontally projecting from the outer tank wall 1 and disposed in the vicinity of the equator of the tank and in a circumferential position spaced therebelow; and 5 are stiffeners interposed between said upper and lower rings 3 and 4. Designated at 6 are support chocks circumferentially equispaced and fixed to the lower surface of the lower support ring 4, said support chocks being placed on support blocks 8 fixed on a support deck 7, with a suitable pressure-resistant heat insulating material interposed therebetween. Such support arrangement allows the expansion and contraction of the tank. The character 9 designates a secondary wall heat insulating device and 10 designates an upper deck.

The heat insulating device 2, whose details are shown in FIG. 2, comprises a number of heat insulating unit block plates 15 attached to the surface of the outer tank wall 1, said block plates being formed of a rigid foam resin 11 such as rigid urethane which serves as a heat insulating material, having plywood sheets 12 and 13 bonded to the outer and inner surfaces thereof, with a gas-tight sheet 14 such as an aluminum sheet bonded to the outer surface of the plywood sheet 12. Each of said heat insulating unit block plates 15 has a substantially centrally disposed through-hole 16 extending in the direction of the thickness thereof and adapted to receive a stud bolt 17 fixed to the surface of the outer tank wall 1 as by welding, said block plates being fixed to the outer tank wall 1 by heat insulating bolts 18 of synthetic resin or the like inserted in said through-holes 16 and threadedly engaged with said stud bolts 17. Designated at 19 is a nut threadedly engaged with the front end of the heat insulating bolt 18 to fix the block plate 15 to the outer tank wall 1 as described above, and 20 is a plywood washer interposed between said nut 19 and block plate 15. A plurality of point spacers 21 are interposed between the back surfaces of said block plates 15 and the outer tank wall 1. The point spacers 21 prevent the heat insulating unit block plates 15 from being overclamped by the heat insulating bolts 18, and also serve to define a space between the outer tank wall 1 and the lower surfaces of the block plates 15 to provide a flow passage 23 so that in the event of the leakage of the low temperature liquified gas the leakage gas can be guided to a reservoir 22 through said flow passage. Designated at 24 is a soft foam resin such as soft urethane foam serving as a heat insulating material stuffed into said flow passage. It allows the flow of leakage gas into the reservoir 22 while performing the function of heat insulation between said outer tank wall 1 and the block plates 15.

Designated at 25 is a heat insulating filler such as single kraft paper faced figerglass used to fill the joints between the heat insulating unit block plates 15. After being bent with a jig applied to the middle portion, it is inserted in the joint until its front end almost touches the outer tank wall 1 and then it is bonded to the opposed lateral surfaces of the heat insulating unit block plates 15. Instead of using fiberglass, a soft foam resin 25*a* may be injected into the joint to fill the same, as shown in FIG. 2*a*Designated at 26 is a gas-tight sheet of glass cloth or the like used to cover the exposed top portions of the heat insulating bolt 18 and nut 19, the peripheral edge of said sheet being fixed to the heat insulating unit block plates 15 by staples 27.

The order of construction will now be described with reference to FIGS. 3*a*–3*d.*

Figure 3A:
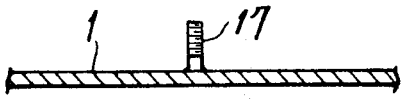
Figure 3D:
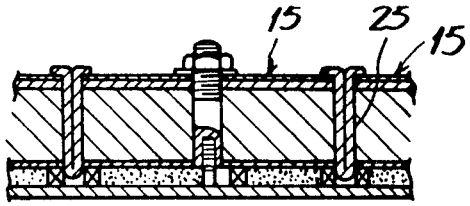
Figure 3B:
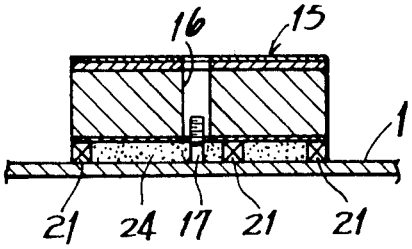
Figure 3C:
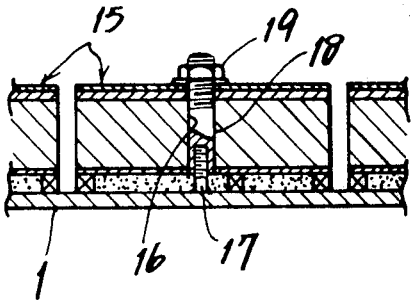

First of all, the locations on the outer tank wall 1 at which the stud bolts 17 are to be set are marked and the stud bolts 17 are then fixed as by welding, as shown in FIG. 3*a.* In conformity with the positions of the stud bolts 17, the heat insulating unit block plates 15 are bored with through-holes 16 substantially at their centers and said block plates 15 are then fitted on said stud bolts 17 through said through-holes 16, as shown in FIG. 3*b.* On the other hand, point spacers 21 are applied for example at the corners on the lower surfaces of the heat insulating unit block plates 15, while soft foam resin 24 is stuffed between the block plates 15 and the outer tank wall 1. Subsequently, heat insulating bolts 18 are threadedly engaged with said stud bolts 17 through said through-holes 16 and nuts 19 are screwed on the front ends of the heat insulating bolts 18 so as to press the heat insulating unit block plates 15 against the outer tank wall 1, as shown in FIG. 3*c.* At this time, the clearances between the heat insulating bolts 18 and the block plates 15 are filled with an adhesive agent, but for the lower half of the tank a highly viscous adhesive is used to prevent the dripping of such adhesive agent. Next, a heat insulating filler 25 is bent with a jig applied to the central portion thereof and then inserted in the joint between the heat insulating unit block plates 15, as shown in FIG. 3*d.* The heat insulating filler 25 is bonded to the opposed lateral surfaces of the block plates 15 and the exposed ends of the filler 25 are bent over and bonded to the gas-tight sheets 14 on the block plates 15. The exposed top portions of the heat insulating bolts 18 and nuts 19 and the exposed top portions of the heat insulating joint filler 25 are then covered with gas-tight sheets 26 of glass cloth or the like with their peripheral edges fixed in position by staples 27 and their surfaces suitably coated with resin.

FIG. 4 shows the cross-section of a heat insulating unit block plate 15*a,* which is one of the heat insulating unit block plates 15 disposed on the lower end of the tank at a position opposed to the reservoir 22. A pipe 28 is inserted from the outside into said block plate 15*a* until it reaches the above-mentioned flow passage 23, and a soft foam resin 29 such as soft urethane foam is stuffed into the interior so as to permit leakage gas flowing down said flow passage 23 to be discharged while maintaining said flow passage 23 and block plate 15*a* gas-tight.

In the case of leakage of liquified gas from the tank, the plywood sheets 13 on the heat insulating unit block plates 15 serve as a barrier so that the leakage gas, without going outside through the block plates 15, flows down the outer tank wall through the flow passage 23 and collects in the region of the heat insulating block plate 15*a* on the lower end of the tank, and since the pressure becomes higher than in the outside it is discharged through the pipe 28 and collects in the reservoir 22. The gas-tightness between the inside and outside of the heat insulating device 2 is maintained by the soft foam resin 29 stuffed into the pipe 28.

The heat insulating construction of the tank support section will now be described.

FIGS. 5 and 6 show the principal portions of the tank support section. Pressure-resistant heat insulating members 30, 31 and 32 are applied to the lower and right and left surfaces of the support chock 6 fixed to the lower surface of the lower support ring 4. The lower pressure-resistant heat insulating member 30 is placed on the support block 8, while the pressure-resistant heat insulating members 31 and 32 on both sides are supported to be slidable radially of the tank by opposed brackets 33 and 34 fixed to the support block 8, thus allowing the expansion and contraction of the tank, as described above. Designated at 37 is an upper laminated heat insulating member disposed between the upper lateral surface of the support chock 6 opposed to the tank and the heat insulating device 2 on the outer tank wall 1, and it is adhesively bonded to the surface of the heat insulating unit block plates 15, to the lower surface of the lower support ring 4 and to the upper lateral surface of the support chock 6 opposed to the tank, with the direction of lamination being for example horizontal, through glass mesh 38 disposed along the surface of the heat insulating unit block plate 15 of the heat insulting device 2 and the lower surface of the lower support ring 4. Designated at 39 is a lower laminated heat insulating member adhesively bonded to the lateral surface region of the chock 6 extending to its lower end and below the upper heat insulating laminated member 37 in such a manner that the direction of lamination is for example is vertical. These laminated heat insulating members 37 and 39 are each composed of a plurality of adhesively laminated soft foam resin plates 40 such as soft urethane foam provided with resin films. The space between the end of the lower laminated heat insulating member 39 and the lateral surface of the lower pressure-resistant heat insulating member 30 is filled with a soft foam resin 41, and soft resin sheets 42 are bonded to the surfaces of the soft foam resin 41 and the laminated heat insulating members 37 and 39.

Instead of being bonded to the lateral surface of the support chock 6 opposed to the outer tank wall 1, the laminated heat insulating members 37 and 39 may be bonded to other lateral surface. Further, for the heat insulation of other locations on the support chock 6 than where it has the laminated heat insulating members bonded thereto and locations on the stiffeners 5, the construction of said heat insulating device 2 or the construction using the soft foam resin and soft resin sheets are suitably applied.

We claim:

1. In a heat insulating device for the wall of a spherical low temperature liquified gas storage tank, the improvement comprising:

a plurality of heat insulating unit block plates each consisting of a rigid foam synthetic resin plate, inner and outer plywood members bonded to the inner and outer surfaces respectively of said resin plate, a gas-tight sheet bonded to the outer surface of said outer plywood member, and a hole disposed substantially centrally of said block plate and extending through said gas-tight sheet, said plywood members and said resin plate;

a plurality of point spacers disposed between the inner surface of each block plate and the outer surface of said tank wall to define a space between the block plates and the tank wall;

heat insulating connecting means inserted in said holes for fixing said unit block plates relative to the tank wall and said point spacers;

heat insulating filler means placed in the joints between said unit block plates; and gas-tight means for covering the exposed outer portions of said connecting means and said filler means.

2. A heat insulating device as set forth in claim 1, wherein said gas-tight sheet is an aluminum sheet.

3. A heat insulating device as set forth in claim 1, wherein said filler means consists of single kraft paper faced fiberglass bonded to the lateral surfaces of said heat insulating unit block plates.

4. A heat insulating device as set forth in claim 1, wherein said filler means consists of a soft foam resin injected into the joints.

5. A heat insulating device as set forth in claim 1, wherein the gas-tight means for covering the exposed top portions of the connecting means and filler means consists of glass cloth.

6. A heat insulating device as set forth in claim 1, wherein said connecting means includes a stud secured to the outer tank wall, and a bolt of insulating material extending through said hole into threaded engagement with said stud.

7. A heat insulating device as set forth in claim 1 wherein said space between said tank wall and block plates is filled with a soft foam resin.

8. A heat insulating device as set forth in claim 1 further comprising a communication pipe mounted in one block plate disposed in the vicinity of the lower portion of the spherical tank and allowing the space defined by said point spacers to communicate with the outer side of said insulating device.

9. A heat insulating device as set forth in claim 8, wherein the space defined by said spacers and also said communication pipe are filled with a soft foam resin.

* * * * *